United States Patent [19]

Reich et al.

[11] Patent Number: 4,785,587

[45] Date of Patent: Nov. 22, 1988

[54] NOVEL LAP FOR THE POLISHING OF GEM STONES

[75] Inventors: Shymon Reich; David Vofsi, both of Rehovot, Israel

[73] Assignee: Yeda Research & Development Co., Ltd., Rehovot, Israel

[21] Appl. No.: 386,677

[22] Filed: Jun. 7, 1982

[30] Foreign Application Priority Data

Jun. 5, 1981 [IL] Israel ..... 63054

[51] Int. Cl.[4] ..... B23F 21/03

[52] U.S. Cl. ..... 51/209 R; 51/314; 51/283 R

[58] Field of Search ..... 51/209, 283, 314, 322, 51/356, 266, 165.73

[56] References Cited

U.S. PATENT DOCUMENTS

| | | | |
|---|---|---|---|
| 193,306 | 7/1877 | White | 51/322 |
| 1,213,164 | 1/1917 | Graat | 51/283 |
| 2,419,739 | 4/1947 | Spina | 51/283 |
| 2,429,961 | 10/1947 | Rakowitzky | 51/283 |
| 2,641,879 | 6/1953 | Dalrymple | 51/322 |
| 3,745,722 | 7/1973 | Balz | 51/314 |

*Primary Examiner*—E. R. Kazenske
*Assistant Examiner*—Willmon Fridie, Jr.
*Attorney, Agent, or Firm*—Browdy and Neimark

[57] ABSTRACT

There is provided a scaife for the polishing of gemstones wherein the abrasive material is embedded in a matrix of a material maintained in the solid state, which material has a high enthalpy of phase transition from solid to liquid. Suitable materials are frozen water, frozen water/organic liquid mixtures such as water/alkanol mixtures and suitable metals or metal alloys. There is also provided a process for the polishing of gemstones which comprises a process for the polishing of gemstones which comprises establishing a layer of abrasive embedded in a suitable solid matrix in or on the surface of a rotatory plate and polishing said gemstones, overheating being prevented by the high enthalpy of solid/-liquid transition of the said matrix.

6 Claims, 1 Drawing Sheet

FIG. 1
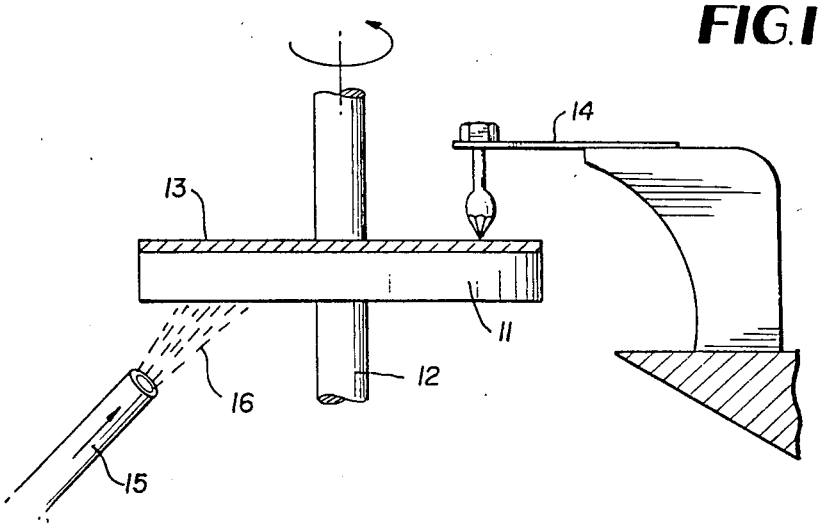
FIG. 2
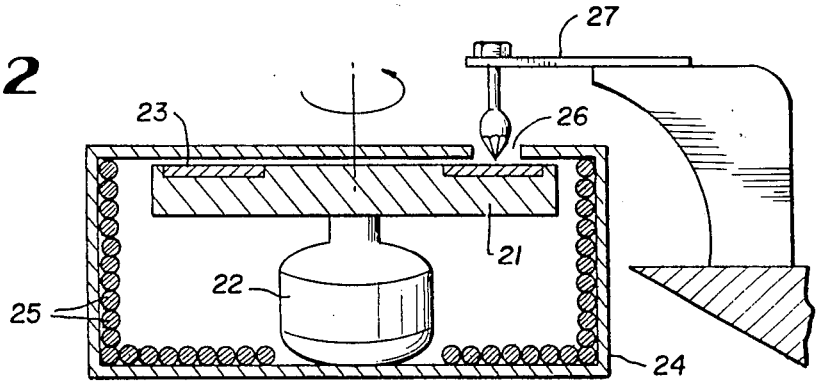
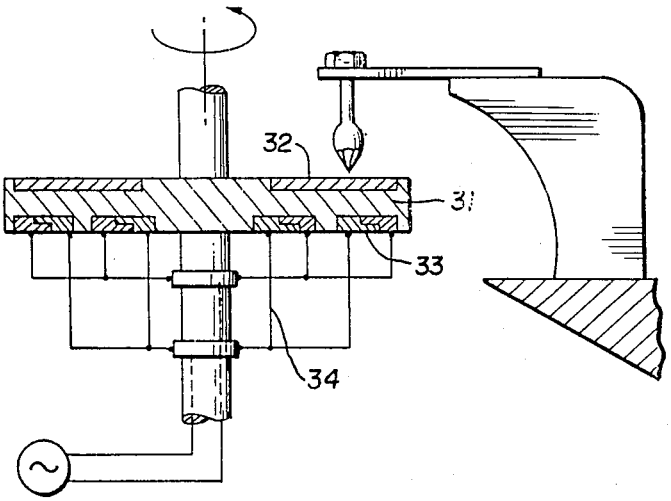
FIG. 3

NOVEL LAP FOR THE POLISHING OF GEM STONES

FIELD OF THE INVENTION

The present invention relates to a novel scaife for the polishing of gemstones. The novel scaife is intended for the polishing of hard gemstones by means of abrasive dust. A preferred embodiment of the invention relates to a novel scaife for the polishing of diamonds by means of diamond dust. Another relates to the polishing of emeralds by means of suitable abrasives.

STATE OF THE PRIOR ART

Classical scaifes made of cast iron of high silicon and phosphorus content are in wide-spread use for the polishing of diamonds by means of diamond dust, and of other gems, like emeralds, by similar abrasives. Such conventional scaifes are hard and porous and hold the abrasive, such as diamond dust, very well. The speed of polishing is limited by the danger of local overheating of the gem which is being polished. Such overheating is likely to damage the gem or it may melt the dop in which it is imbedded. At speeds of revolution exceeding about 3000 rpm a very careful balancing of the scaife is required and the scaife must be initially substantially true and plane.

SUMMARY OF THE INVENTION

The present invention relates to an improvement of scaifes used for the polishing of hard gemstones by means of abrasive powder. The invention is illustrated with reference to the polishing of diamonds and emeralds, but it ought to be understood that it is applicable to the polishing of other hard gemstones by means of suitable abrasive powders.

According to the invention there is provided a scaife provided with a surface layer consisting of a matrix in which there are embedded fine particles of a suitable abrasive. The matrix is chosen in such manner that it has a suitable phase transition temperature between solid/-liquid, which will not be appreciably higher than the local temperature at the contact of the gemstone and the surface during the polishing process.

A suitable matrix is ice. Other suitable matrices are suitable metals or alloys. The high enthalpy of melting of the matrix during the phase transition prevents a heating of the gem during polishing to substantially above this temperature.

In the case of diamond polishing the scaife is advantageously provided with a surface layer of a frozen matrix material containing a suitable quantity of diamond dust. When the tang is applied to the scaife, the polishing remains thermostatic up to very high speeds (i.e. up to speeds as high as about 100,000 rpm), as the temperature cannot practically exceed the melting temperature of the frozen surface layer or of the metal matrix. The use of the novel scaife is very economical on the quantity of diamond dust used, as a melting process occurs only momentarily at the point of contact of the gem with the surface of the scaife. The lubricant for the diamond dust in the polishing process of the present invention is the molten matrix which is in immediate contact with the gem, and the temperature of this liquid is close to the melting point so that isothermal low temperature conditions are carefully maintained practically throughout the entire polishing process. The process of polishing according to the present invention does not require any wet-conditioning of the scaife.

Amongst the main advantages of the novel scaife there may be mentioned the following:

a. Isothermal low temperature polishing with substantially no overheating of the polished gem;
b. Feasibility of high speed polishing, up to about 100,000 rpm;
c. Isothermal conditions make possible an accurate polishing of the gemstones;
d. Great economy in the use of diamond powder as the powder is embedded in a suitable matrix, such as a frozen surface layer or in a suitable alloy, which is momentarily melted locally, only when contact is established with the gem during polishing;
e. Lubrication and abrasive material are supplied at the very spot of contact with the gem due to local melting which takes place when the gem is pressed against the scaife;
f. The scaife is well balanced and perfectly plane, as it is solidified it situ from a liquid mixture;
g. No wet conditioning of the scaife is required.

The freezing of the surface layer and the maintenace of its low temperature is advantageously effected by means of a circulating low-temperature liquid or gas, such as liquid nitrogen.

The invention is illustrated with reference to the enclosed schematical drawings, not according to scale, in which:

FIG. 1 is a side view in partial section of a polishing device with scaife according to the invention;

FIG. 2 is a side view in partial section of another embodiment of a polishing device of the invention;

FIG. 3 is another sectional side view of a scaife of the invention with other polishing implements.

As shown in FIG. 1, the device comprises a circular metal plate 11, having an axis 12 which is provided with means for rotating same (not shown), to which there is applied a surface layer 13 comprising a suitable matrix in which abrasive particles are embedded. The gemstone is mounted on a conventional dop and tang 14, and this is pressed against the surface of the scaife during polishing. There is provided a tubular member 15, located beneath the plate 11, which directs a stream of liquified nitrogen 16 against the lower surface of the said plate, maintaining the same at a low temperature. A suitable matrix is ice, which is maintained in the frozen state and undergoes local melting at the contact with the gemstone, and immediately solidifies again.

The device shown in FIG. 2 comprises a circular scaife 21, driven by motor 22, said scaife being provided with a groove 23 at its surface, in which there is provided the matrix with the abrasive powder. The scaife is positioned in a housing 24 providing the thermal insulation, which is maintained at a low temperature by means of a refrigerant flowing through the cooling coils 25. There is provided an opening 26 at the upper plate of the housing, and this provides access of dop and tang 27 holding the gemstone to the upper surface of the scaife.

Another embodiment is illustrated by FIG. 3 where the scaife plate 31 is provided with a groove 32 holding the matrix and abrasive, and which plate is also provided with a plurality of Peltier elements 33 connected by wires 34 to a current source, which elements provide a cooling effect which maintains the matrix and abrasive at the required low temperature.

The upper layer of the scaife illustrated in FIG. 1 can be conveniently applied by placing a suitable sheet of filter paper on the upper surface of the plate, imbuing it with water and abrasive powder and freezing it. This results in a plane frozen upper surface which is immediately ready for use.

The abrasive is generally in the form of very fine particles, which may be in the range of parts of microns. For certain uses the size may be in the micron range. The abrasive particles can be embedded in any matrix which is suitable by its physico-chemical properties and particularly by a suitable phase transition temperature of solid to liquid. Thus the matrix may be any suitable frozen carrier. The matrix can also be a suitable metal or alloy. In these, the temperature of the facet will not exceed during the polishing process the said phase transition temperature as this is the upper limit due to the good heat conductivity and the inherent enthalphy of the materials used. Suitable metals and alloys are as follows:

| | | | | |
|---|---|---|---|---|
| (1) Ternary Eutectic | Ga 62.5% | In 21.5% | Sn 16.0% | |
| (2) Wood's Metal | Bi 50% | Pb 25% | Sn 12.5% | Cd 12.5% |
| (3) Binary Eutectic | In 67.0% | Bi 33.0% | | |
| (4) Newton's Metal | Bi 50.0% | Sn 18.8% | Pb 31.2% | |
| (5) Rose's Metal | Bi 50.0% | Pb 28.0% | Sn 22.0% | |
| (6) Binary Eutectic | Sn 75.0% | Pb 25.0% | | |
| (7) Binary Eutectic | Tl 52.0% | Bi 48.0% | | |

A typical scaife has a diameter of 50 cm. It can be made of cast iron, provided with a surface layer of filter paper which is imbued with a suspension of abrasive diamond dust in water and frozen by application of a jet of liquid nitrogen to the lower surface of the plate which is located in an open top freezer. The surface is thus maintained well below the melting point of the ice. The polishing process results in a momentary melting of the ice at the point of contact, but this immediately freezes again due to the low temperature and thus the overall frozen surface is maintained for a prolonged period of time. On the entire surface there is applied about 1 (one) carat of diamond dust, of the type usually used for polishing purposes.

EXAMPLE

Diamond dust of about 3 μm average particle size was dispersed in water containing 10% by weight ethanol and this suspension was poured on a plane aluminum disk provided with means for cooling with a stream of liquified nitrogen (about −80° C.). The surface layer, about 3 mm thick, was immediately frozen, forming a uniform plane layer. The scaife with the surface layer containing the abrasive material was rotated at 10,000 rpm. The diamond to be polished was mounted on a conventional dop and tang and this was applied to the scaife with a pressure of about 1,000 g. The process of polishing was essentially isothermal, the working temperature being a function of the melting temperature of the frozen surface layer.

We claim:

1. A scaife for the polishing of gemstones, comprising a rotatory plane disk provided at or in its upper surface with a frozen liquid matrix containing abrasive powder, said matrix being characterized by having a phase transition temperature between solid/liquid not appreciably higher than the local temperature created at a point of contact between said matrix and a gemstone being polished, and a high enthalpy of phase transition from solid to liquid to thereby constitute means for allowing local melting of said matrix at a point of contact between said matrix and the generated gemstone being polished followed immediately by refreezing.

2. A scaife according to claim 1, wherein the matrix is ice.

3. A scaife according to claim 1, wherein the matrix comprises water and alkanol.

4. A scaife according to claim 1, wherein the matrix is a metal or a metal alloy.

5. A scaife according to claim 1, wherein the abrasive is diamond dust.

6. A scaife according to claim 1, provided with means for maintaining same at a low temperature

* * * * *